US006982137B2

(12) United States Patent
Berghauser

(10) Patent No.: US 6,982,137 B2
(45) Date of Patent: Jan. 3, 2006

(54) METHOD OF FORMING IMAGES ON TILES, GLASS OR OTHER SURFACES, AND ARTICLES PRODUCED BY THE METHOD

(76) Inventor: Donald C. Berghauser, 538 Gladiola Dr., Clark Summit, PA (US) 18411

( * ) Notice: Subject to any disclaimer, the term of this patent is extended or adjusted under 35 U.S.C. 154(b) by 0 days.

(21) Appl. No.: 10/294,699

(22) Filed: Nov. 15, 2002

(65) Prior Publication Data

US 2003/0113652 A1 Jun. 19, 2003

Related U.S. Application Data

(60) Provisional application No. 60/331,467, filed on Nov. 16, 2001.

(51) Int. Cl.
*G03G 13/16* (2006.01)

(52) U.S. Cl. ..... 430/14; 430/126

(58) Field of Classification Search ..... 430/14, 430/126, 124
See application file for complete search history.

(56) References Cited

U.S. PATENT DOCUMENTS 4,529,650 A * 7/1985 Martinez ..... 428/336
5,871,837 A * 2/1999 Adair ..... 428/206
6,106,982 A * 8/2000 Mientus et al. ..... 430/14
6,420,090 B1 * 7/2002 Kojima et al. ..... 430/284.1

* cited by examiner

*Primary Examiner*—John L Goodrow
(74) *Attorney, Agent, or Firm*—Penrose Lucas Albright

(57) ABSTRACT

A method of producing a substrate having a color image applied thereto wherein said image was produced by a xerographic process wherein the substrate is first provided with an electrostatically applied powder coating which can be clear epoxy-polyester, acrylic, urethane or the like, curing the polyester coating to an eighty to ninety-five percent cure at a temperature of about 350°. to 400° F. applying said xerographically produced color image which has been applied to a backing sheet to said first coating and pressing said image against said first coating at about 40 psi with a press temperature of about 400° F. for about 3.5.–4 minutes, allowing the composite so produced to cool, applying electrostatically thereto a further polymer which is the same as the first polymer to encase the image therein. The composite is then heated for a sufficient time to achieve a complete cure. A further coating, such as acrylic coating may be applied and the substrate may be a glass which, in both cases, largely eliminate ultraviolet radiation from being received by the image.

12 Claims, No Drawings

METHOD OF FORMING IMAGES ON TILES, GLASS OR OTHER SURFACES, AND ARTICLES PRODUCED BY THE METHOD

PRIOR PROVISIONAL APPLICATION

Specific reference is hereby made to Provisional Application No. 60/331,467 filed Nov. 16, 2001.

FIELD OF THE INVENTION

The invention is directed to the transfer of color images formed by a xerographic process onto substrates such as tile, glass or the like whereby the finished product is resistant to scratches, abrasions, corrosion, ultraviolet radiation, etc.

BACKGROUND OF THE INVENTION

Transfer sheets are commercially available for receiving and transferring color images produced by xerographic processes to substrates. In general, such transfer sheets comprise an upper layer wherein various xerographic toner colors are formed into the desired color images. The image layer is bonded to a second layer which consists of polymer material that protects and forms a transparent layer over the image layer. Next to this layer is a peeling or backing layer which enables further layers of the transfer sheet to be removed when the image and top layer are applied to a substrate. In its simplest form, a transfer sheet is pressed against a hard surface such as tile and the backing layer is peeled off. Such transfers are, however, likely to be defective and can be easily scratched. If an ultraviolet light protective material is included in a polymer material which overlays the image, a limited ultraviolet protection to the image results. In general, such a tile can be improved by baking it for fifteen minutes at 400° F. It can be further improved by coating the image and polymer protective layer with a further layer which is resistant to wear and tear. Still further improvement can be obtained by baking the further coating again at about 400° F. for about fifteen minutes. A problem with transfers is that although good results are often possible, the transfer sheets tend to be expensive and rejections in production may be as high as twenty to forty percent with returns being in the five to ten percent range. In addition, the ultraviolet light protection is often inadequate for any extended period of time for images which nay be exposed to sunlight or otherwise experience relatively to high ultraviolet radiation. Such images may include signs and structures which are applied to inflexible substrates and frequently are used in outdoor setting wherein the durability of the image is an important quality. Such signs are typically produced in low volumes or may be one of a kind. Even so, they are usually made by a silk screen printing process which is not cost effective for one of a kind or a small production runs.

Further it has been a long standing problem with color photographs which are displayed that over a period of time that their colors tend to fade due to ultraviolet radiation. Thus a need has long existed for a means of producing color images which are not unduly expensive and resist fading due to ultraviolet radiation, particularly of the kind experienced in outdoor settings, but also, to a lesser degree, to that experienced with indoor illumination.

SUMMARY OF THE INVENTION

An object of the instant invention is to provide a method and article produced thereby which is cost effective and which is resistant to damage which may be imposed on the images due to exposure over a substantial length of time due to ultraviolet radiation as well as damage caused by other corrosive and abrasive agents.

The first step of the invention is providing electrostatic powder deposition coating onto a tile to which the image is to be applied. The substrate should be perfectly clean to receive the electrostatic coating which, for the most purposes, is a clear coating. The coating can be epoxy-polyester, acrylic or urethane or a combination thereof. Polyester is preferred because most toners used in xerographic processors are composed of polyester materials. Powder coating is preferred but the electrostatic coating may also be applied as a liquid. The substrate so-coated, is heated in an oven at a temperature of about 400° to an eighty to ninety-five percent cure. In this connection the timing of the heating step is important. Commercially available materials for this step customarily set forth the period of time required for the particular material to achieve an eighty to ninety-five percent cure. Because the degree of cure is critical in the process, the testing of samples to ensure that an appropriate and most advantageous degree of cure within the 80–95% range is ascertained and used is recommended for best results.

After the desired degree of cure has been obtained, the substrate together with the electrostatic powder coating thereon is removed from the oven and permitted to cool to ambient temperature. In the meanwhile, a xerographic color print having the desired image is produced. Typically, the toners used in such processes are dry. However, liquid toners can be used. As indicated above, the toner is preferably polyester. The transfer print is placed, as desired, face down, that is with the toners in contact with the electrostatic powder coating and, as such, is placed in a heat press wherein a pressure of about 40 psi is applied to the back of the print. The pressure should, in any event, be sufficient to provide a continuous contact between the xerographic produced image and the coating. The combination is heated to about 350 to 400° F. for typically about three and one-half to four minutes. If this period of time is insufficient, the image may not bond sufficiently with the coating. If the period of time is too long, the print paper is difficult to separate from the image without smearing the toners. When the step is completed, the substrate together with the electrostatic coating and the image which has been transferred thereto are cooled to a temperature of less than 100° F. and the transfer sheet, less the image, is peeled off of the substrate leaving the image bonded to the coating. Thereafter, the first step of electrostatically coating, over the prior coating and the image, however, is repeated with the same material and the second coating is heated to 400° F. for about fifteen minutes or as sufficient to achieve a complete cure of both the first and second coatings which were electrostatically deposited on the substrate with the xerographically produced color image being encased between the two coatings which are, in effect, bonded into a fully integrated layer with the image encased therein and similarly bonded thereto.

Depending on the use of the article produced by the foregoing steps, a further acrylic layer may be applied electrostatically for the purpose of reducing the amount of ultraviolet radiation to which the image is subjected. If the substrate is glass, preferably that glass is of a type that suppresses ultraviolet radiation.

DETAILED DESCRIPTION OF THE PREFERRED EMBODIMENTS

A suitable substrate which has or is caused to have a desired geometric configuration is selected and surface thereof is cleaned, Preferably the substrate is ceramic tile or glass through which the image will be seen and which will adequately filter out damaging ultraviolet radiations. However, the substrate may be of other materials such as, for example, a treated canvas. The surface of the substrate should be, as indicated above, cleaned and, as such, be coated with a polyester coating as provided, for example, by Polytech Coating Labs Reztech P-04-08, Cardinal T-209-c101 or Tiger Drylac 49/00530. The electrostatic coating is cured to 80–95 percent of the recommended cure cycle. This varies by brand, but usually is for a period of 8 to 15 minutes at 350 to 400° F.

A transfer sheet is produced via a xerographic electrostatic process on a CANON Color Copier, a QMS magi color 2 desk laser printer or a Xerox printer. Unless the substrate is glass wherein the image will be viewed through the glass, the image is printed in a mirror image mode on special paper such as FlexiTrans from Transfer Technology or Magic Touch CPM.6.0.

The substrate with the electrostatically polyester coating is preferably cooled and the transfer sheet is then applied to that coated surface, using any heat transfer method well known in the art, such as a flat heat press. A pressure adequate to ensure complete contact of the image to the coating, usually about 40 psi, is applied to the back of the transfer print for three and one-half to four minutes. However, the transfer sheet is not fully heated to 400° F. because, in practice, an one-fourth inch silicone pad is placed between the middle head of the heat press and the coated substrate with the transfer sheet thereon. The back of the transfer sheet can then be peeled off or preferably is cooled to less than 100° F. and then removed.

The final step is electrostatically to coat the substrate with the previous coating and the image applied thereto. Preferably the same material is used in this final step and the composite article is heated for about fifteen minutes to achieve a complete cure and integral bonding between the first and second electrostatic coatings whereby the images are encased between the two integrated layers. Finally, as set forth above, a further layer may be applied which may be an acrylic provided to filter out ultraviolet radiation from being received, at least in large part, by the encased image. If glass is used as a substrate, the final layer may be a further opaque layer. In either event, preferably the final layer is also electrostatically deposited.

The final product produced by the above method is sturdy and, with appropriate filtration of ultraviolet radiation, is long lasting not only in an indoor illumination setting but also for outdoor use. For example, uses contemplated is for the article include being fixed to tombstones or being use for outdoor architecture or in outdoor parks and gardens or to indicate recreation trails.

The following are a list product manufacturers for materials used in the inventive process to obtain the novel articles resulting therefrom:

A. Coatings

Tiger Drylac, Ontario, CA. 91761

Series 09 clear-polyester-epoxy blend

Series 49C Clear—polyester

Polytech Coating Labs.—Reading, Pa.

Reztech Series P—Clear—polyester

Reztech Series H—polyester—epoxy blend

Cardinal Industrial Finished—Warren, Pa.

T-209—C102—Polyester

Ferro Corp.—Brecksville, Ohio

158C121 clear—Acrylic

B. Transfer Material

Magic Touch—Mundelein, Ill.

COM 6.0

Transfer Technology—Thornton, N.H.

Flexitrans

Visual Communicator—New York, N.Y.

SS-500

Although I have described the preferred embodiments of my invention, it is to be understood that it is capable of other adaptations and modifications within the scope of the appended claims.

What is claimed is:

1. A method of applying xerographically produced images to a substrate which comprises electrostatically depositing a polymer coating on the substrate and heating such coating to achieve about a eighty to ninety-five percent cure at a temperature in the range of of about 350° F.–400° F., producing by a xerographic process a color image on a backing layer and pressing said image against said coating with sufficient pressure to achieve a desired transfer of said image to said coating herein the temperature of the press is about 400° F. and the period that pressure is applied by said press is in the range of about three to five minutes, removing said backing layer, electrostatically depositing the same polymer as used for the first coating over said first coating and said image and heating said substrate, said coatings and said image encased between said coatings to about 350° F.–400° F. for a sufficient time to achieve a complete cure of said coatings and integrally to bond said coatings together.

2. A product produced by the method of claim 1.

3. A method of applying xerographically produced images to a substrate which comprises providing a coating by an electrostatically powder deposition of a polymer on the substrate and heating such coating to achieve about an eighty to ninety-five percent cure at a temperature in the range of 350° F.–400° F., providing a color image produced by a xerographic process on a backing layer and pressing said image against said coating with sufficient pressure to achieve a desired transfer of said image to said coating wherein the temperature of the press is about 400° F. and the period that pressure is applied by said press is in the range of about three to five minutes, removing said backing layer, electrostatically depositing by an electrostatic deposition process the same polymer as used for the first coating over said first coating and said image and beating said substrate, said coatings and said image encased between said coatings to about 350° F.–400° F. for a sufficient time to achieve a complete cure of said coatings and integrally to bond said coatings together.

4. A product produced by the method claim 3.

5. A method in accordance with claim 3, wherein said image is protected from adverse effects due to exposure to ultraviolet radiation.

6. A method in accordance with claim 3, wherein said coatings consist essentially of an epoxy-polyester or an acrylic or a urethane or a combination thereof.

7. A method in accordance with claim 3, wherein said image consists of toners which are essentially polyesters.

8. A method in accordance with claim 3, wherein said sufficient pressure is about 40 pounds per square inch.

9. A method in accordance with claim 3, wherein said substrate is a transparent material which sufficiently prevents ultraviolet radiation from causing color toners of said image to fade.

10. A method in accordance with claim 3, wherein a step is included of cooling said backing layer with said color image thereon before pressing said image against said coating to achieve the transfer thereof to the first of said coatings.

11. A method of applying xerographically produced images to a substrate which comprises electrostatically depositing by a dry electrodeposition process a polymer coating on the substrate and heating such coating to achieve about an eighty to ninety-five percent cure at a temperature of about 350° F.–400° F., producing by a xerographic process a color image consisting of toners that are essentially polymers on a backing layer and pressing said image against said coating with sufficient pressure to achieve a correctly complete transfer of said image to said coating wherein the temperature of the press is about 400° F. and the period that pressure is applied by said press is in the range of about three to five minutes, removing said backing layer, electrostatically depositing by a dry electrodeposition process the same polymer as used for the first coating over said first coating and said image to blend with said image and heating and said substrate, said coatings and said image encased between said coatings to about 350° F.–400° F. for a sufficient time to achieve a complete cure of said coatings and integrally to bond said coatings together.

12. A product produced by the method of claim 11.

* * * * *